US008047494B2

(12) United States Patent
Chang

(10) Patent No.: US 8,047,494 B2
(45) Date of Patent: Nov. 1, 2011

(54) TOOL FOR CLAMPING OPTICAL GLASS ELEMENT

(75) Inventor: Wei-Yao Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 436 days.

(21) Appl. No.: 12/344,648

(22) Filed: Dec. 29, 2008

(65) Prior Publication Data

US 2009/0322007 A1 Dec. 31, 2009

(30) Foreign Application Priority Data

Jun. 25, 2008 (CN) ..... 2008 1 0302312

(51) Int. Cl.
*A47G 1/10* (2006.01)

(52) U.S. Cl. ..... 248/316.1; 269/45; 269/143; 269/249

(58) Field of Classification Search ..... 248/313, 248/316.1, 316.5, 229.1, 229.13, 229.23, 248/231.51, 309.1, 316.3, 226.11, 278.1; 269/249, 143, 45

See application file for complete search history.

(56) References Cited

U.S. PATENT DOCUMENTS

| | | | | |
|---|---|---|---|---|
| 3,263,535 | A * | 8/1966 | Zurcher | 81/302 |
| 4,183,512 | A * | 1/1980 | Goff et al. | 269/185 |
| 5,058,869 | A * | 10/1991 | Ruthven | 269/45 |
| 5,991,997 | A * | 11/1999 | Schley et al. | 29/426.5 |
| 6,000,686 | A * | 12/1999 | Yates | 269/6 |
| 6,126,671 | A * | 10/2000 | Richards et al. | 606/190 |
| 6,755,382 | B1 * | 6/2004 | Melnick | 248/316.8 |
| 6,893,012 | B2 * | 5/2005 | Wong | 269/249 |
| 2009/0218454 | A1 * | 9/2009 | Stanley | 248/121 |

* cited by examiner

*Primary Examiner* — Ramon Ramirez
(74) *Attorney, Agent, or Firm* — Altis Law Group, Inc.

(57) ABSTRACT

A tool for clamping an optical glass element includes a first arm, a second arm, a first clamping portion and a second clamping portion. The first and second arms are pivotally connected with each other and are rotatable relative to each other about a first axis. The first clamping portion is rotatably connected to an end portion of the first arm distal from the first axis and is rotatable relative to the first arm about a second axis. The second axis is substantially perpendicular to the first axis. The second clamping portion is rotatably connected to an end portion of the second arm distal from the first axis and is rotatable relative to second arm about a third axis. The third axis is substantially perpendicular to the first axis. The first and second clamping portions are configured for cooperatively clamping the optical glass element therebetween.

20 Claims, 6 Drawing Sheets

TOOL FOR CLAMPING OPTICAL GLASS ELEMENT

BACKGROUND

1. Technical Field

The present disclosure relates to a tool for clamping an optical glass element.

2. Description of Related Art

With the ongoing development of microcircuitry and multimedia technology, digital cameras are growing in use. High-end portable electronic devices, such as mobile phones and PDAs (Personal Digital Assistants), are being developed to be increasingly multi-functional. Many of these portable electronic devices are now equipped with a digital camera. The camera generally includes at least an optical glass element such as a lens.

The lens needs to undergo appearance inspection before it is installed into an optical glass barrel. The appearance inspection includes steps as follows. A light source is provided to illuminate the surface of a lens. Then an inspector checks the lens for defects, for example if there is dust or scratches on the surface of the lens. The lens is usually held by gloved hand during the inspection process. Unfortunately, gloves may mar the surface of the optical glass element.

What is needed, therefore, is a tool for clamping optical glass elements to overcome the above shortcoming.

BRIEF DESCRIPTION OF THE DRAWINGS

Many aspects of the present tool for clamping optical glass elements can be better understood with reference to the following drawings. The components in the drawings are not necessarily drawn to scale, the emphasis instead being placed upon clearly illustrating the principles of the present tool for clamping optical glass elements. Moreover, in the drawings, like reference numerals designate corresponding parts throughout the several views.

DETAILED DESCRIPTION OF THE EMBODIMENT

Reference will now be made to the drawings to describe present embodiments of the present tool for clamping an optical glass elements.

Figure 1:
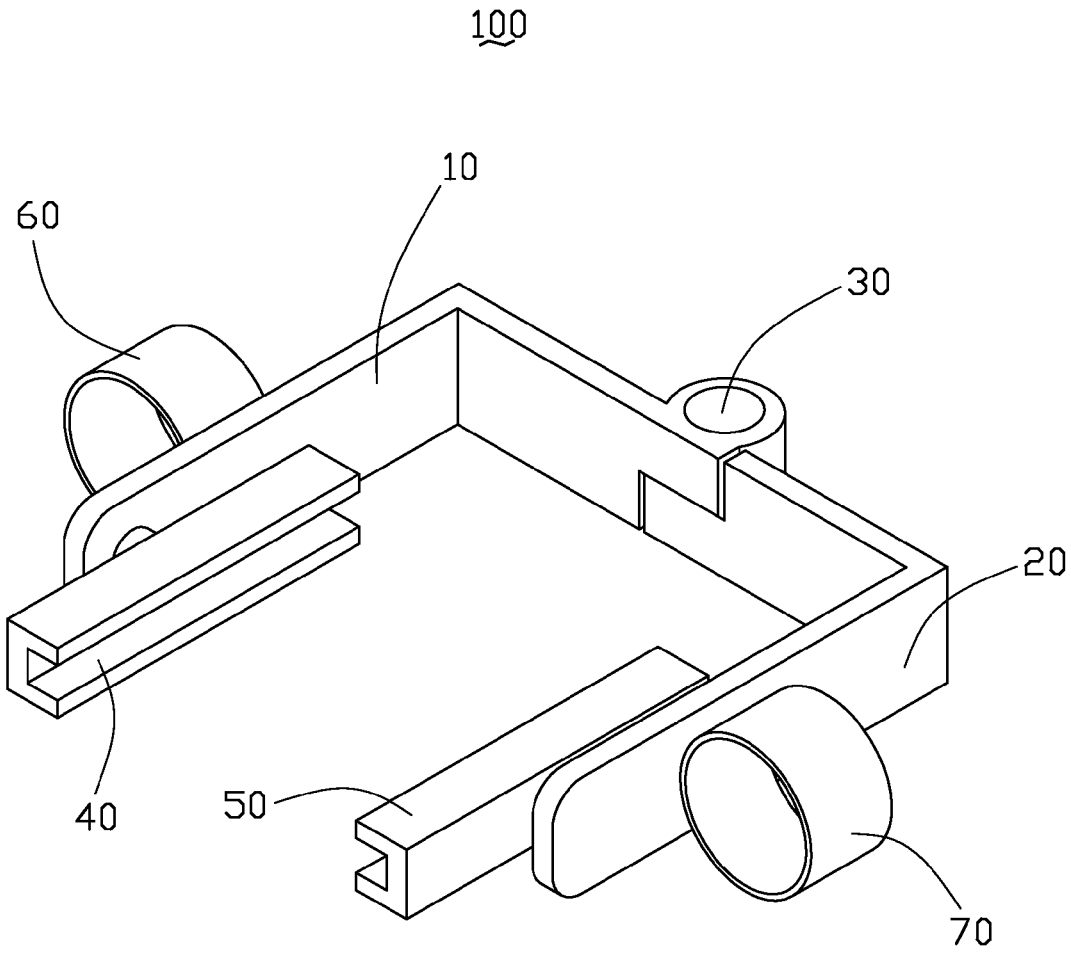
FIG. 1 is a schematic, isometric view of a tool for clamping an optical glass element according to an embodiment.
Figure 2:
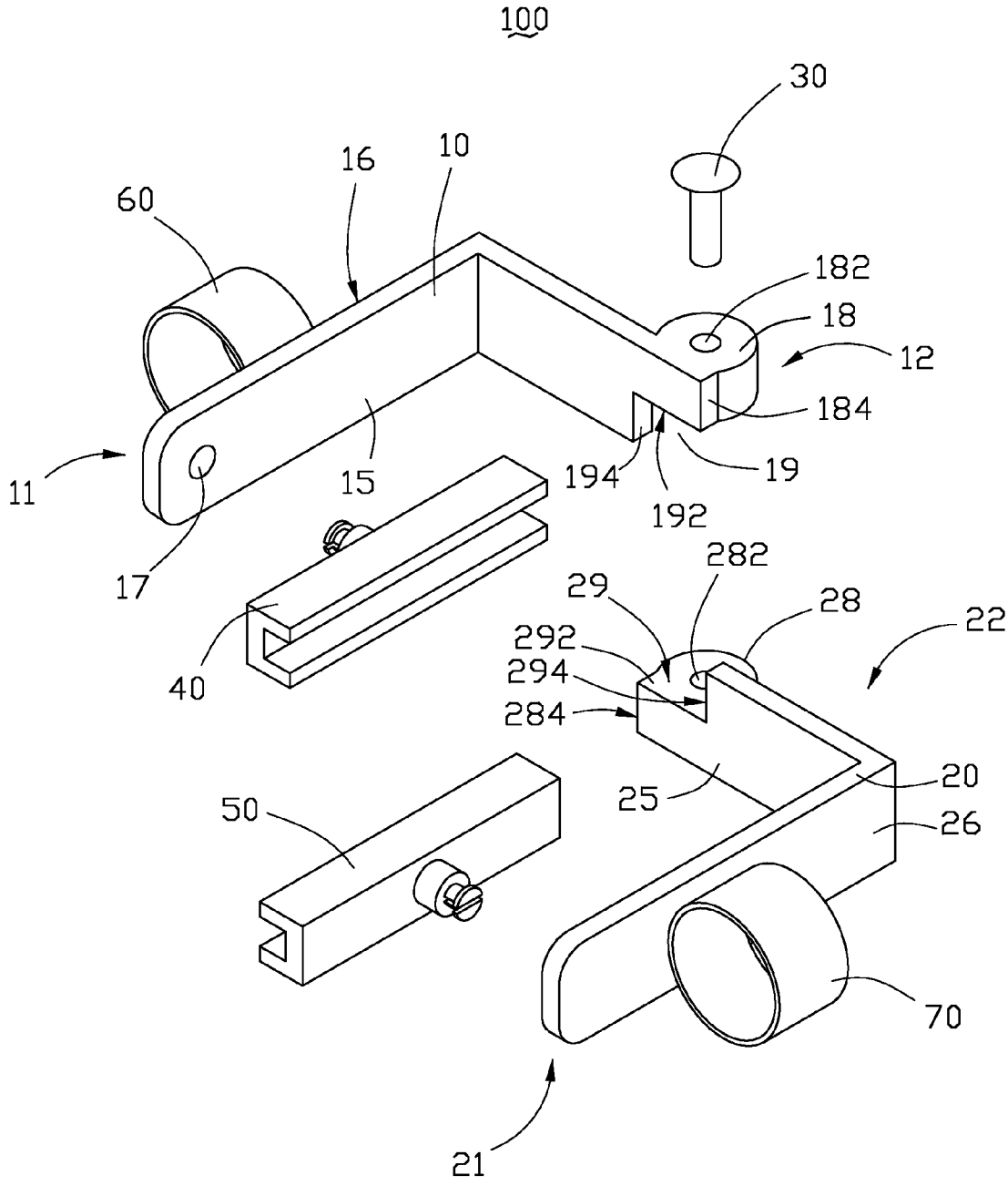
FIG. 2 is an exploded, isometric view of the tool in FIG. 1 which includes two clamping members.

Referring to FIGS. 1 and 2, a tool 100 for clamping an optical glass elements (see the lens 80 in FIG. 6) is provided according to an exemplary embodiment. The tool 100 is configured for clamping an optical glass element during an appearance inspection of the element.

The tool 100 includes a first arm 10, a second arm 20, a first clamping portion 40, a second clamping portion 50, a first finger ring 60 and a second finger ring 70.

The first arm 10 includes a first elongated free portion 11 and a first elongated connection portion 12. The first elongated free portion 11 and the first elongated connection portion 12 are connected with each other to form a right angle. The second arm 20 includes a second elongated free portion 21 identical to the first elongated free portion 11 and a second elongated connection portion 22 identical to the first elongated connection portion 12. The first arm 10 and the second arm 20 are pivotally connected with each other at distal ends of the first elongated connection portion 12 and the second elongated connection portion 22.

The first clamping portion 40 is rotatable and detachably connected to the first elongated free portion 11 and the second clamping portion 50 is rotatable and detachably connected to the second elongated free portion 21. The first clamping portion 40 faces towards the second clamping portion 21.

The first elongated free portion 11 has a first surface 15 facing the second elongated free portion 21 and a second surface 16 facing away from the first surface 15. The first clamping portion 40 is rotatable and detachably mounted in the first surface 15. The first finger ring 60 is fixed on the second surface 16.

The first elongated connection portion 12 includes a first connection end 18 configured for connecting with the second arm 20. The first connection end 18 has a cylindrical shape. A first through hole 182 is defined in the first connection end 18 along a direction parallel with the central axis thereof. A notch 19 is formed by cutting out a portion of the first connection end 18 along a direction parallel with the central axis of the first through hole 182 and a direction perpendicular to the central axis of the first through hole 182. The notch 19 is shaped by a first horizontal surface 192 and a first vertical surface 194 adjacent to the first horizontal surface 192. The first through hole 182 extends through the first horizontal surface 192. The first connection end 18 has a first side surface 184 adjacent to the first horizontal surface 192 and parallel to the first vertical surface 194.

The second elongated connection portion 22 includes a second connection end 28 identical to the first connection end 18. The second elongated connection end 28 defines a through hole 282 therein identical to the through hold 182 and a second notch 29 identical to the first notch 19. The second notch 29 is defined by a second horizontal surface 292 identical to the first horizontal surface 192 and a second vertical surface 294 identical to the first vertical surface 194. The second connection end 28 has a second side surface 284 identical to the first side surface 184.

Figure 3:
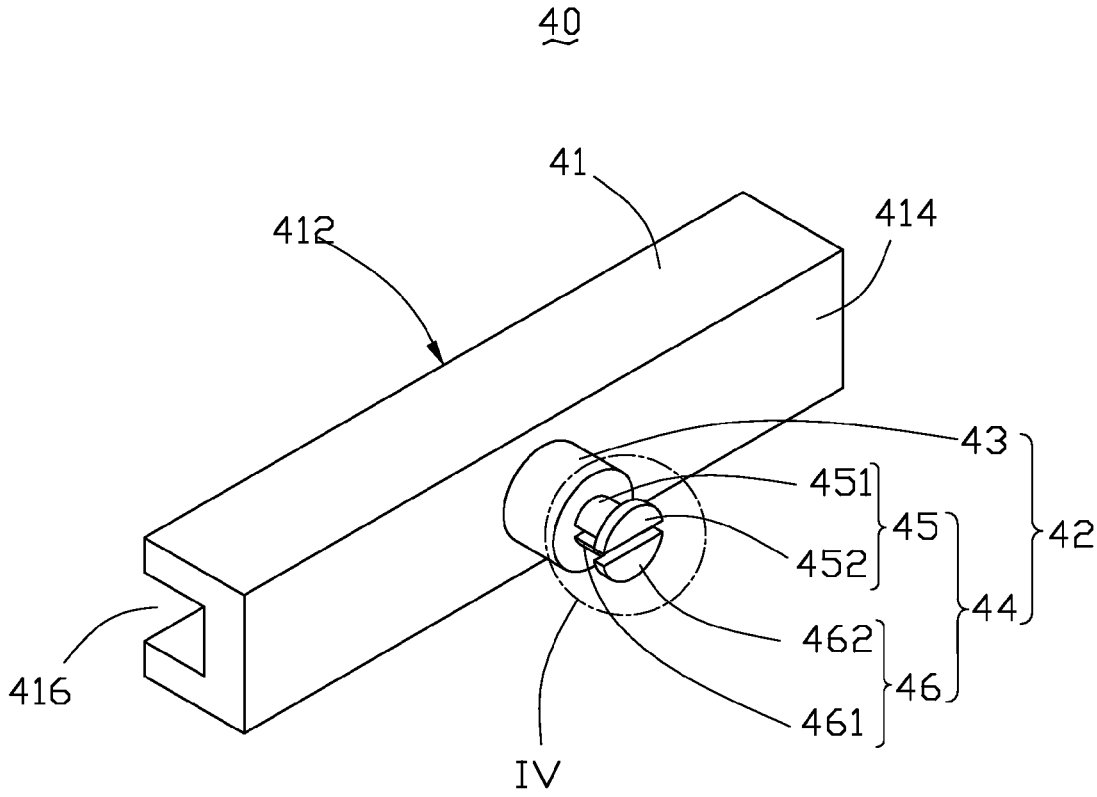
FIG. 3 is an isometric view of the clamping members shown in FIG. 2.

Referring to FIGS. 1 to 3, the first elongated connection portion 12 is pivotally connected with the second elongated connection portion 22 so that the first through hole 182 and the second through hole 282 are aligned with each other and a rivet 30 may be inserted into the first through hole 182 and the second through hole 282. The first connection end 18 occupies the second notch 29 and the second connection end 28 occupies the first notch 19. The first side surface 184 faces towards the second vertical surface 294, the first vertical surface 194 faces towards the second side surface 284, and the first horizontal surface 192 faces towards the second horizontal surface 292. The first side surface 184 and the second vertical surface 294 are spaced apart and the first vertical surface 194 and the second side surface 284 are spaced apart so that the first arm 10 can rotate relative to the second arm 20 about the central axis of the first through hole 182 and the central axis of the second through hole 282. The rotation of the first arm 10 and the second arm 20 can move the first elongated free portion 11 and the second elongated free portion 21 move toward or away from each other.

In this embodiment, the first finger ring 60 is a hook-and-loop fastener. The hook-and-loop fastener has two opposite sides, one of which is covered with tiny hooks and the other of which is covered with even smaller and hairier loops (see Wikipedia, key word: "Velcro"). The two sides of the hook-and-loop fastener are pressed together to form a ring, thus the first finger ring 60 is formed. The first finger ring 60 can be stuck to the second surface 16 with glue.

The second finger ring 70 is identical to the first finger ring 70. A connection relation between the second finger ring 70 and the second elongated free portion 21 is identical to the connection relation between the first finger ring 60 and the first elongated free portion 11.

Figure 4:
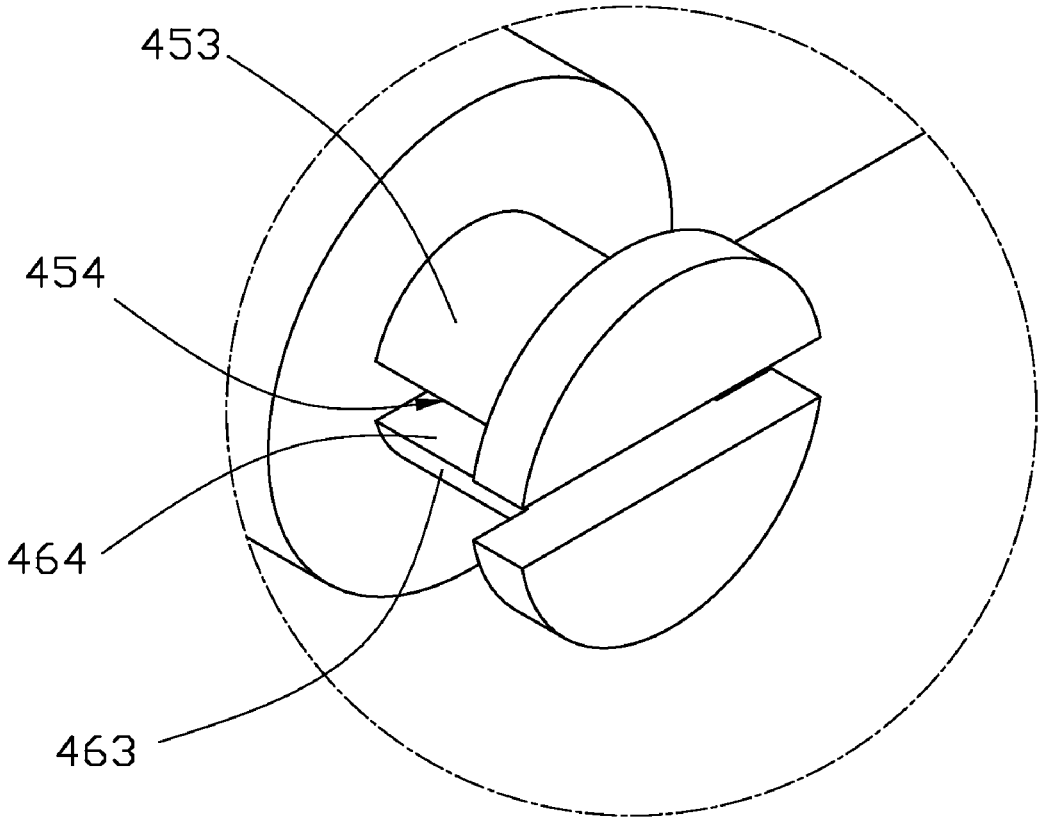
FIG. 4 is an enlarged view of a circled portion IV of a clamping member in FIG. 3.

Referring to FIGS. 2 to 4, the first clamping portion 40 includes a first clamping member 41 and a first connection member 42. The first clamping portion 40 is elongation-shaped and has two opposite side surfaces 412 and 414. A rectangular groove 416 is defined in the side surface 412 along an elongated direction of the first clamping portion 40. The rectangle groove 416 is configured for receiving one side of the lens 80. The first connection member 42 is positioned on the side surface 414. The first connection member 42 is integrally connected with or fixed to the first clamping portion 40. The first connection member 42 includes a base 43 and an inserter 44 integrally connected with or fixed to the base 43. The base 43 is positioned on side surface 414. The inserter 44 is positioned on the base 43.

The inserter 44 includes two protrusions 45 and 46 facing each other. The protrusion 45 includes a semicircular-cylindrical shaped post 451 and an annular flange 452. The semicircular-cylindrical shaped post 451 has a semi-cylinder surface 453 and a flat surface 454 adjacent to the curved surface 453. Both of the semi-cylinder surface 453 and the flat surface 454 are parallel to the central axis of the semicircular-cylindrical shaped post 451. The hemi-toroidal flange 452 extends away from the semi-cylinder surface 453 and is coaxial to the semicircular-cylindrical shaped post 451. The central axis of the semicircular-cylindrical shaped post 451 is perpendicular to the side surface 414. The protrusion 46 is identical to the protrusion 45. A flat surface 464 of the protrusion 46 faces towards the flat surface 454 of the protrusion 45. In this embodiment, the flat surface 454 is parallel with and space from the flat surface 464. The second clamping portion 50 is identical to the first clamping portion 40.

A first receiving hole 17 is defined in the first surface 15. In this embodiment, the first receiving hole 17 has a cylindrical shape. Preferably, the central axis of the first receiving hole 17 is perpendicular to the central axis of the first through hole 182. The first connection member 42 is rotatable and detachably engaged with the first receiving hole 17. The diameter of the peripheral of the hemi-toroidal flange 452 is equal to or less than the diameter of the first receiving hole 17 so that the semicircular-cylindrical shaped posts 451 and the hemi-toroidal flange 452 can enter into the first receiving hole 17. A plus of the diameter of the semicircular-cylindrical shaped post 452 and the distance between the flat surfaces 454 and 464 is greater than the diameter of the first through hole 17. The second elongated free portion 21 has a second receiving hole (not shown) identical to the first receiving hole 17 in a first surface (not shown) of the second elongated free portion 21 facing towards the first surface 15 of the first elongated free portion 11. Preferably, the central axis of the second receiving hole of the second elongated free portion 21 is perpendicular to the central axis of the second through hole 282.

When assembling the first clamping portion 40 with the first arm 10, force are applied to the protrusions 45 and 46 to make one part of the flat surface 454 of the protrusion 45 contact one part of a flat surface 464 of the protrusion 46. Then the inverter 44 is inserted into the first through hole 17 and the force applied to the protrusions 45 and 46 is released. Because the diameter of the semicircular-cylindrical shaped post 452 and the distance between the flat surfaces 454 and 464 is greater than the diameter of the first through hole 17, an internal stress exists in the inserter 44. The first arm 10 defines an inner surface (not labeled) in the first through hole 17. Thus, the peripheries of the hemi-toroidal flange 452 of the first protrusion 451 and a hemi-toroidal flange 462 of the second protrusion 46 press the inner surface of the first through hole 17 because of the internal stress in the inserter 44. In addition, the first clamping portion 40 can rotate about the central axis of the first through hole 17. The second clamping portion 50 is assembled with the second arm 20 in the same manner. The first clamping portion 40 faces the second clamping portion 50 when the first and second clamping portions 40 and 50 are assembled.

Figure 5:
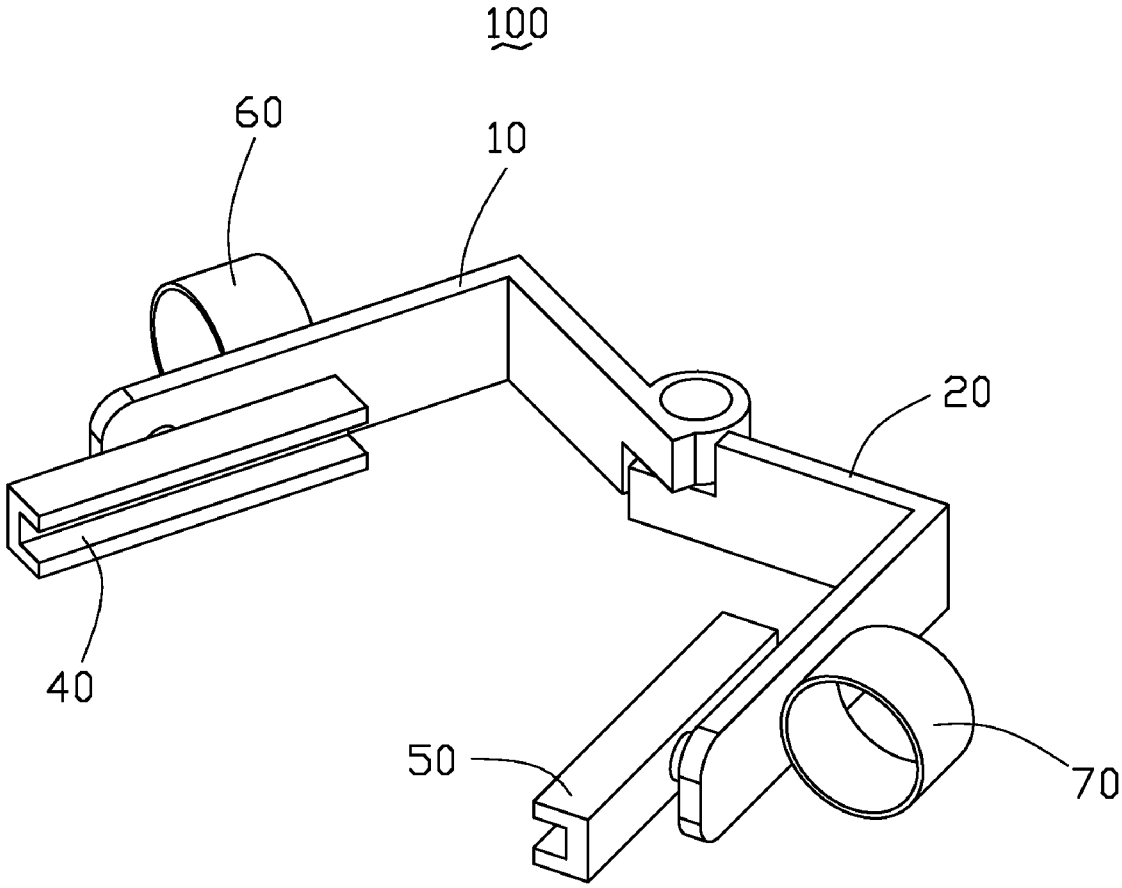
FIG. 5 is an isometric view of the tool in FIG. 1 which is in an opening state.
Figure 6:
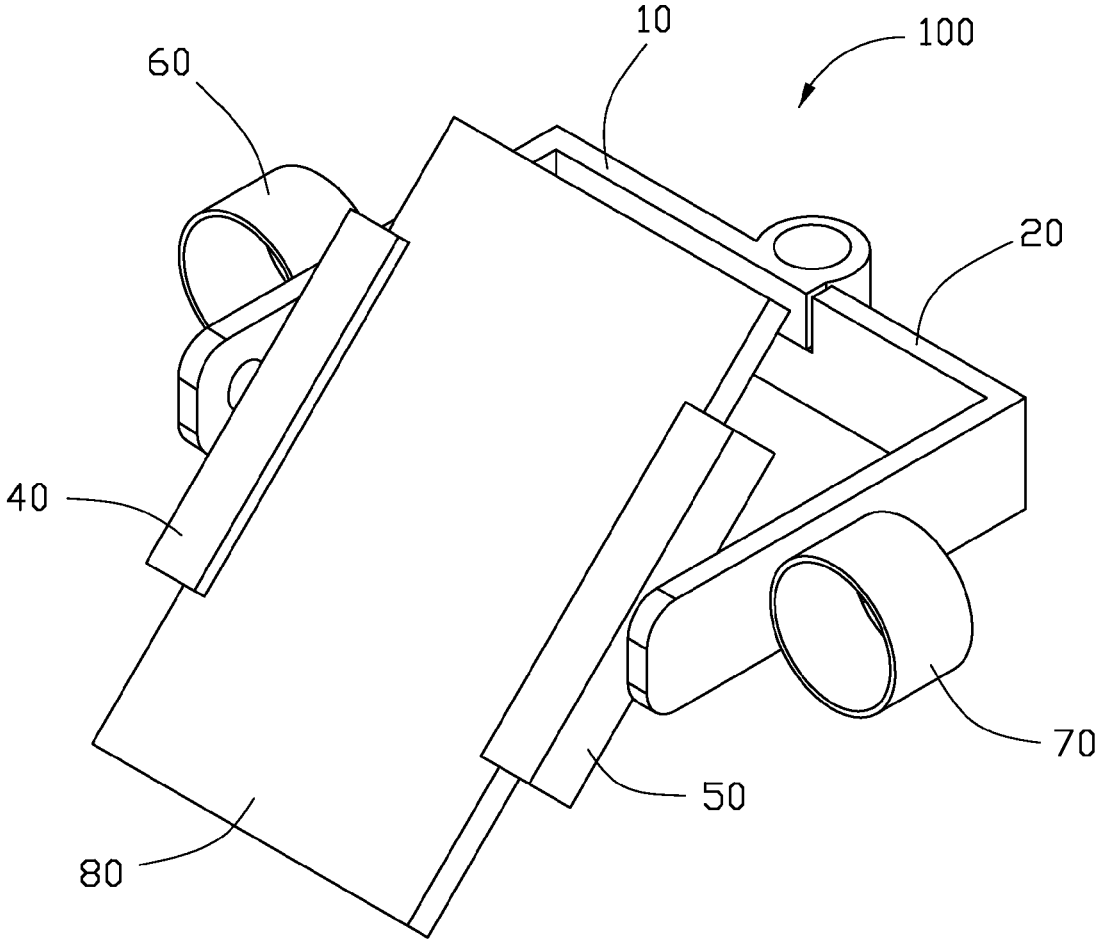
FIG. 6 is an isometric view of the tool in FIG. 1 which is clamping an optical glass element.

Referring to FIGS. 5 and 6, a method using the tool 100 for clamping an optical glass element is described in detail as follows. Firstly, a user inserts two fingers (not shown) through the two finger rings 60 and 70, and then rotates the first arm 10 and the second arm 20 about the central axis of the first through hole 182 to an "open" state with turning action of their two fingers. In other words, the first elongated free portion 11 and the second elongated free portion 21 are moved apart from each other.

Secondly, the lens 80 is arranged between the first and second clamping portions 40 and 50 so that two opposite sides of the lens 80 are partly received in the first receiving groove 416 and a second receiving groove 53 of the second clamping portion 50. Then the first arm 10 and the second arm 20 are rotated about the central axis of the first through hole 182 to a "closed" state. In other words, the first elongated free portion 11 and the second elongated free portion 21 are moved close to each other to clamp tightly the lens 80.

Furthermore, a light source is provided to illuminate the lens 80. Then an appearance inspection is performed. During the inspection process, the lens 80 can be rotated by rotating the first and second clamping portions 40 and 50 for convenient inspection of the two surfaces of the lens 80.

Using the tool 100 for clamping the lens 80 avoid having the surface of the lens 80 marred by human touch gloved or otherwise. In addition, the lens 80 can be rotated freely by rotating the clamping portions 40 and 50.

It is to be understood that the shape of the first and second arms 10 and 20 can also be arc-shaped etc., not limited to an "L" shape formed by the elongated free portion and the elongated connection portion. In addition, the curved surface of the protrusion of the inverter can also correspond to a central angle of less than or more than 180 degrees, not limited to the semicircular-cylindrical shape. Certainly, the shape of the curved surface can also be an elliptic cylinder, etc., as long as the inverter can be rotatably received in the receiving hole.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool for clamping an optical glass element, comprising:

a first arm;

a second arm, the first and second arms being pivotally connected with each other, the first arm and the second arm being rotatable relative to each other about a first axis;

a first clamping portion rotatably connected to an end portion of the first arm distal from the first axis, the first clamping portion being rotatable relative to the first arm about a second axis, the second axis being substantially perpendicular to the first axis; and a second clamping portion rotatably connected to an end portion of the second arm distal from the first axis, the second clamping portion being rotatable relative to the second arm about a third axis, the third axis being substantially perpendicular to the first axis;

the first and second clamping portions configured for cooperatively clamping the optical glass element therebetween.

2. The tool as claimed in claim 1, wherein each of the first and second arms comprises a first elongated portion and a second elongated portion distinctly oriented from and connected with the first elongated portion, the first elongated portions of the first and second arms rotatably connected with the first and second clamping portions, the second elongated portions of the first and second arms being pivotally connected with each other.

3. The tool as claimed in claim 2, wherein each second elongated portion is perpendicular to the corresponding first elongated portion.

4. The tool as claimed in claim 3, wherein each first elongated portion has an inner surface, and a receiving hole in the inner surface, each clamping portion comprising a clamping member and a connection member connected with the clamping member, the clamping member being configured for contacting the optical glass element and the connection member being rotatably engaged in the corresponding receiving hole.

5. The tool as claimed in claim 4, wherein each first elongated portion has an outer surface, and a finger ring fixed on the outer surface for inserting a finger therethrough.

6. The tool as claimed in claim 4, wherein each clamping member has two opposite side surfaces, and a groove defined in one of the two side surfaces, the connection member being fixed on the other side surface, the groove being configured for receiving the optical glass element.

7. The tool as claimed in claim 6, wherein each connection member comprises a base fixed on the other side surface of the respective clamping member and two spaced protrusions extending from the base, the two protrusions being rotatably received in the receiving hole, each first elongated portion having an inner surface in the receiving hole, the protrusions biasingly engaged in the corresponding receiving hole.

8. The tool as claimed in claim 7, wherein each protrusion comprises a semicircular-cylindrical shaped post and a hemi-toroidal flange extending outwardly from the semicircular-cylindrical shaped post, a diameter of the of the hemi-toroidal flange being equal to or less than the diameter of the corresponding receiving hole.

9. The tool as claimed in claim 2, wherein each second elongated portions comprises a connection end adjacent to the first axis, the connection end having a cylindrical body and a through hole defined therein along a direction parallel with the first axis, the through holes of the second elongated portions being aligned with each other, and a rivet being inserted into the through holes to fasten the first and second arms together.

10. A tool for clamping an optical glass element, comprising:

a first arm;

a second arm, the first and second arms being pivotally connected with each other, the first arm and the second arm being rotatable relative to each other about a first axis;

a first clamping portion rotatably connected to an end portion of the first arm distal from the first axis, the first clamping portion being rotatable relative to the first arm about a second axis, the second axis being substantially perpendicular to the first axis; and a second clamping portion rotatably connected to an end portion of the second arm distal from the first axis, the second clamping portion being rotatable relative to the second arm about a third axis, the third axis being substantially perpendicular to the first axis;

the first and second clamping portions configured for cooperatively clamping the optical glass element therebetween, each of the first and second arms comprising a first elongated portion and a second elongated portion distinctly oriented from and connected with the first elongated portion, the first elongated portions of the first and second arms rotatably connected with the first and second clamping portions, the second elongated portions of the first and second arms being pivotally connected with each other, each first elongated portion has an outer surface, and a finger ring fixed on the outer surface for inserting a finger therethrough.

11. The tool as claimed in claim 10, wherein each second elongated portion is perpendicular to the corresponding first elongated portion.

12. The tool as claimed in claim 11, wherein each first elongated portion has an inner surface, and a receiving hole in the inner surface, each clamping portion comprising a clamping member and a connection member connected with the clamping member, the clamping member being configured for contacting the optical glass element and the connection member being rotatably engaged in the corresponding receiving hole.

13. The tool as claimed in claim 12, wherein each clamping member has two opposite side surfaces, and a groove defined in one of the two side surfaces, the connection member being fixed on the other side surface, the groove being configured for receiving the optical glass element.

14. The tool as claimed in claim 13, wherein each connection member comprises a base fixed on the other side surface of the respective clamping member and two spaced protrusions extending from the base, the two protrusions being rotatably received in the receiving hole, each first elongated portion having an inner surface in the receiving hole, the protrusions biasingly engaged in the corresponding receiving hole.

15. The tool as claimed in claim 14, wherein each protrusion comprises a semicircular-cylindrical shaped post and a hemi-toroidal flange extending outwardly from the semicircular-cylindrical shaped post, a diameter of the of the hemi-toroidal flange being equal to or less than the diameter of the corresponding receiving hole.

16. A tool for clamping an optical glass element, comprising:

a first arm;

a second arm, the first and second arms being pivotally connected with each other, the first arm and the second arm being rotatable relative to each other about a first axis;

a first clamping portion rotatably connected to an end portion of the first arm distal from the first axis, the first clamping portion being rotatable relative to the first arm about a second axis, the second axis being substantially perpendicular to the first axis; and a second clamping portion rotatably connected to an end portion of the second arm distal from the first axis, the second clamping portion being rotatable relative to the second arm about a third axis, the third axis being substantially perpendicular to the first axis;

the first and second clamping portions configured for cooperatively clamping the optical glass element therebetween, each of the first and second clamping portion comprising a clamping member and a connection member connected with the clamping member, each of the first arm and the second arm having a receiving hole, the clamping member being configured for contacting the optical glass element and the connection member being rotatably engaged in the corresponding receiving hole, each clamping member having two opposite side surfaces, and a groove defined in one of the two side surfaces, the connection member being fixed on the other side surface, the groove being configured for receiving the optical glass element.

17. The tool as claimed in claim 16, wherein each of the first and second arms comprises a first elongated portion and a second elongated portion distinctly oriented from and connected with the first elongated portion, the first elongated portions of the first and second arms rotatably connected with the first and second clamping portions, the second elongated portions of the first and second arms being pivotally connected with each other.

18. The tool as claimed in claim 17, each first elongated portion has an inner surface, and the receiving hole is defined in the inner surface.

19. The tool as claimed in claim 18, wherein each connection member comprises a base fixed on the other side surface of the respective clamping member and two spaced protrusions extending from the base, the two protrusions being rotatably received in the receiving hole, each first elongated portion having an inner surface in the receiving hole, the protrusions biasingly engaged in the corresponding receiving hole.

20. The tool as claimed in claim 19, wherein each protrusion comprises a semicircular-cylindrical shaped post and a hemi-toroidal flange extending outwardly from the semicircular-cylindrical shaped post, a diameter of the of the hemi-toroidal flange being equal to or less than the diameter of the corresponding receiving hole.

* * * * *